US009183801B2

(12) United States Patent
Chang et al.

(10) Patent No.: US 9,183,801 B2
(45) Date of Patent: Nov. 10, 2015

(54) SOURCE DRIVER APPARATUS AND DRIVING METHOD OF DISPLAY PANEL

(71) Applicant: Novatek Microelectronics Corp., Hsinchu (TW)

(72) Inventors: Sou-Chieh Chang, Hsinchu (TW); Shun-Hsun Yang, Hsinchu (TW); Tse-Hung Wu, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 86 days.

(21) Appl. No.: 14/018,406

(22) Filed: Sep. 4, 2013

(65) Prior Publication Data

US 2014/0368553 A1 Dec. 18, 2014

(30) Foreign Application Priority Data

Jun. 17, 2013 (TW) ..... 102121411 A

(51) Int. Cl.
*G09G 3/36* (2006.01)

(52) U.S. Cl.
CPC ..... *G09G 3/3614* (2013.01)

(58) Field of Classification Search
None
See application file for complete search history.

(56) References Cited

U.S. PATENT DOCUMENTS

| | | | | |
|---|---|---|---|---|
| 7,304,641 | B2 * | 12/2007 | Rao et al. | 345/209 |
| 2010/0149151 | A1 * | 6/2010 | Nam et al. | 345/211 |

FOREIGN PATENT DOCUMENTS

| | | |
|---|---|---|
| CN | 101408705 | 4/2009 |
| TW | 574681 | 2/2004 |
| TW | I220243 | 8/2004 |
| TW | 200937373 | 9/2009 |
| TW | 201234321 | 8/2012 |

OTHER PUBLICATIONS

"Office Action of Taiwan Counterpart Application", issued on Dec. 9, 2014, p. 1-p. 5.

* cited by examiner

*Primary Examiner* — Kenneth B Lee, Jr.
(74) *Attorney, Agent, or Firm* — Jianq Chyun IP Office

(57) ABSTRACT

A source driver apparatus configured to drive a display panel is provided. The source driver apparatus includes a data operation circuit and a pixel driving circuit. The data operation circuit is configured to receive pixel data and perform a polarity determination operation on the pixel data to determine a polarity distribution information of pixels on the display panel. The pixel driving circuit is coupled to the data operation circuit. The pixel driving circuit is configured to drive the display panel according to the pixel data and the polarity distribution information. Furthermore, a driving method of the display panel is also provided.

8 Claims, 7 Drawing Sheets

SOURCE DRIVER APPARATUS AND DRIVING METHOD OF DISPLAY PANEL

CROSS-REFERENCE TO RELATED APPLICATION

This application claims the priority benefit of Taiwan application serial no. 102121411, filed on Jun. 17, 2013. The entirety of the above-mentioned patent application is hereby incorporated by reference herein and made a part of this specification.

BACKGROUND OF THE INVENTION

1. Field of the Application

The invention is directed to a driver apparatus of an electronic device and a driving method thereof, and more particularly, to a source driver apparatus of a display panel and a driving method thereof.

2. Description of Related Art

Referring to FIG. 1 and FIG. 2. FIG. 1 illustrates a polarity distribution of pixels appeared in a dot inversion on a conventional display panel 10, and FIG. 2 illustrates a schematic waveform diagram of driving voltage outputted by each driving channel in FIG. 1 when being configured to drive the second pixel line. In this example, every pixel would cause a coupling effect to a common electrode voltage Vcom during charging and discharging, and as a result, different offsets are produced on the common electrode voltage Vcom. For instance, according to a polarity distribution of pixels in FIG. 1, an aggregated overall effect of the driving voltage outputted by each driving channel may cause the common electrode voltage Vcom to shift upward. When the offsets of the common electrode voltage Vcom are too large, the display panel may result in a poor screen display condition such as flashing or having crosstalk noise.

In order to improve the aforementioned poor screen display condition, the related art has developed driving methods having different types of dot inversions. FIG. 3 illustrates a polarity distribution of pixels appeared in an alternative dot inversion on a conventional display panel 20, and FIG. 4 illustrates a schematic waveform diagram of driving voltage outputted by each driving channel in FIG. 3 when being configured to drive the second pixel line. In this example, the pixels on the display panel 20 are appeared to be in a polarity distribution of horizontal-2-dot inversion. It can be known from the waveform of the driving voltage shown in FIG. 4 that, the coupling effect to the common electrode voltage Vcom caused by every pixel during charging and discharging would cancel each other out, so that the common electrode voltage Vcom would not be shifted, and thereby the condition of having poor screen display is improved.

However, in the related example of the horizontal-2-dot inversion, even though this type of driving method may improve the condition of having poor screen display, an effect thereof merely limited to reduce the offsets caused by a few display patterns to the common electrode voltage Vcom. In terms of some display patterns, the condition of having poor screen display is still unable to be improved by using the horizontal-2-dot inversion to drive the display panel.

SUMMARY OF THE INVENTION

The invention provides a source driver apparatus capable of improving a display effect of a display panel and providing a favorable display quality.

The invention provides a driving method of the display panel capable of improving a display effect of a display panel and providing a favorable display quality.

The invention provides a source driver apparatus configured to drive a display panel. The source driver apparatus includes a data operation circuit and a pixel driving circuit. The data operation circuit is configured to receive pixel data and perform a polarity determination operation on the pixel data to determine a polarity distribution information of a plurality of pixels on the display panel. The pixel driving circuit is coupled to the data operation circuit and configured to drive the display panel according to the pixel data and the polarity distribution information.

In an embodiment of the invention, the display panel includes a plurality of pixel lines. The data operation circuit sequentially performs the polarity determination operation on the pixel data of the entire pixels of each of pixel lines to determine the polarity distribution information of the pixels on the display panel.

In an embodiment of the invention, the display panel includes a plurality of pixel lines. The data operation circuit sequentially performs the polarity determination operation on the pixel data of at least one part pixels of each of pixel lines to determine the polarity distribution information of the at least one part pixels on the display panel.

In an embodiment of the invention, after the data operation circuit performs the polarity determination operation on the pixel data of the at least one part pixels of each of the pixel lines, the data operation circuit determines whether the pixel data of the entire pixels of each of pixel lines have been completely received.

In an embodiment of the invention, if the pixel data of the entire pixels of each of the pixel lines have been completely received, and the polarity distribution information of the entire pixels of each of the pixel lines has been determined, then the pixel driving circuit drives the display panel according to the pixel data and the polarity distribution information.

In an embodiment of the invention, if the pixel data of the entire pixels of each of the pixel lines have not yet been completely received, then the data operation circuit continuously receives the pixel data of another part pixels of each of the pixel lines and performs the polarity determination operation on the pixel data of the another part pixels of each of the pixel lines to determine the polarity distribution information of the another part pixels on the display panel.

In an embodiment of the invention, the pixel driving circuit is further configured to drive another part pixels of each of the pixel lines on the display panel according to another polarity distribution information.

The invention provides a driving method of the display panel including the following steps. Pixel data are received. A polarity determination operation is performed on the pixel data to determine a polarity distribution information of a plurality of pixels on the display panel. The display panel is driven according to the pixel data and the polarity distribution information.

In an embodiment of the invention, the panel includes a plurality of pixel lines. The step of performing the polarity determination operation on the pixel data includes sequentially performing the polarity determination operation on the pixel data of the entire pixels of each of the pixel lines to determine the polarity distribution information of the pixels on the display panel.

In an embodiment of the invention, the step of performing the polarity determination operation on the pixel data includes sequentially performing the polarity determination operation on the pixel data of at least one part pixels of each of the pixel lines to determine the polarity distribution information of the at least one part pixels on the display panel.

In an embodiment of the invention, the driving method of the display panel further includes determining whether the pixel data of the entire pixels of each of the pixel lines have been completely received after the polarity determination operation is performed on the pixel data of the at least one part pixels of each of the pixel lines.

In an embodiment of the invention, if the pixel data of the entire pixels of each of the pixel lines have been completely received, and the polarity distribution information of the entire pixels of each of the pixel lines has been determined, the display panel is driven according to the pixel data and the polarity distribution information.

In an embodiment of the invention, if the pixel data of the entire pixels of each of the pixel lines have not yet been completely received, then the step of performing the polarity determination operation on the pixel data further includes continuously receiving the pixel data of another part pixels of each of the pixel lines and performing the polarity determination operation on the pixel data of the another part pixels of each of the pixel lines to determine the polarity distribution information of the another part pixels on the display panel.

In an embodiment of the invention, the driving method of the display panel further includes driving another part pixels of each of the pixel lines on the display panel according to another polarity distribution information.

According to the foregoing description, in the embodiments of the invention, the source driver apparatus uses the aforementioned method to dynamically adjust the polarity distribution of the pixels on the display panel in an adaptive manner, and thus the display effect of the display panel is improved, thereby providing the favorable display quality.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DESCRIPTION OF EMBODIMENTS

Figure 5:
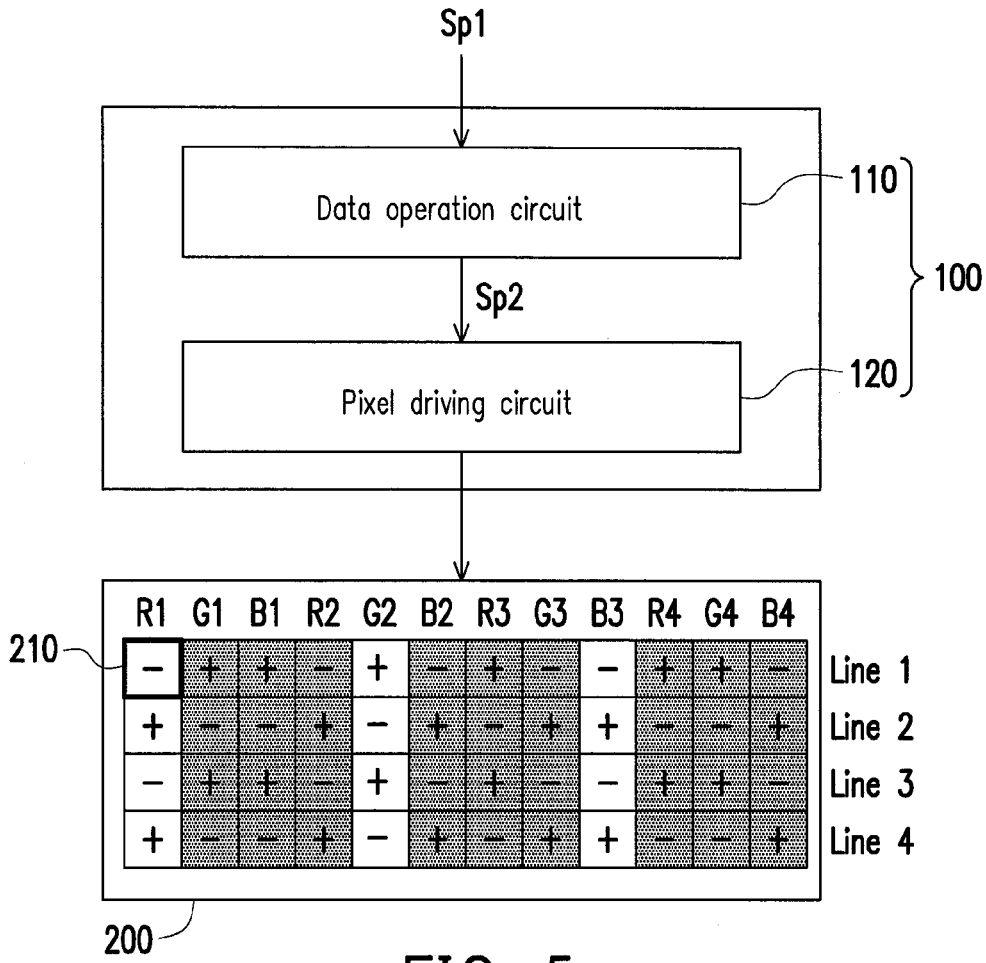
FIG. 5 illustrates a schematic diagram of a source driver apparatus configured to drive a display panel according to an embodiment of the invention.
Figure 6:
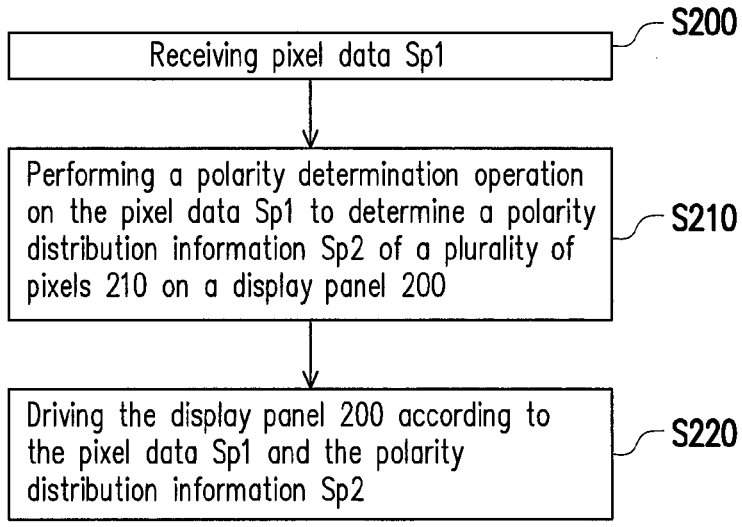
FIG. 6 illustrates a flow chart of a driving method of the display panel according to an embodiment of the invention.

FIG. 5 illustrates a schematic diagram of a source driver apparatus configured to drive a display panel according to an embodiment of the invention. FIG. 6 illustrates a flow chart of a driving method of the display panel according to an embodiment of the invention. Referring to FIG. 5 and FIG. 6, a source driver apparatus 100 of the present embodiment is configured to drive a display panel 200. The source driver apparatus 100 includes a data operation circuit 110 and a pixel driving circuit 120. The pixel driving circuit 120 is coupled to the data operation circuit 110. The data operation circuit 110 is configured to receive pixel data Sp1 (step S200) and perform a polarity determination operation on the pixel data Sp1 to determine a polarity distribution information Sp2 of a plurality of pixels 210 on the display panel 200 (step S210). In the present embodiment, the method for performing the polarity determination operation, for example, is to subtract a gray value of the pixel data of a next line from a gray value of the pixel data of a previous line in the same driving channel, so as to determine the polarity of the pixels located in the next line. Next, the pixel driving circuit 120 drives the display panel 200 according to the pixel data Sp1 and the polarity distribution information Sp2 (step S220). Noteworthily, in the present embodiment, FIG. 5 is only illustrated with 4 pixel lines and 12 driving channels on the display panel 200 for a purpose of providing brief description; and one of the ordinary skill in the art should be able to know that the amounts thereof and the polarity distribution of the pixels described herein are not intended for limiting the invention.

Therefore, in the present embodiment, the polarity distribution of the pixels 210 on the display panel 200 is dynamically determined by the data operation circuit 110 of the source driver apparatus 100 according to an actual image to be displayed by the display panel 200. Namely, the source driver apparatus 100 may dynamically adjust a degree of coupling effect to the common electrode voltage produced by every pixel during charging and discharging to reduce the offset of the common electrode voltage, and thereby improve a condition of having a poor screen display caused by the coupling effect so as to provide a favorable display quality.

Figure 1:
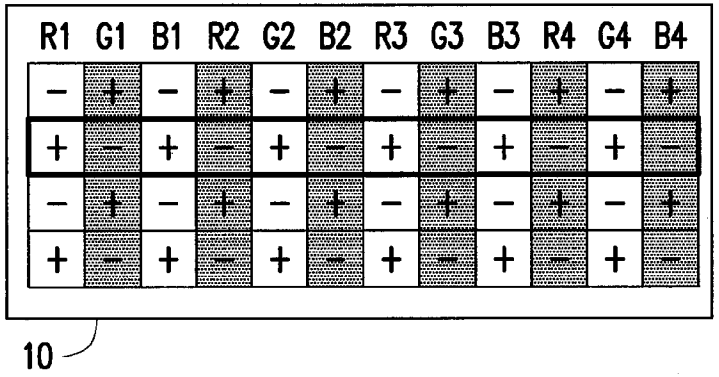
FIG. 1 (RELATED ART)
FIG. 1 illustrates a polarity distribution of pixels appeared in a dot inversion on a conventional display panel 10.
Figure 2:
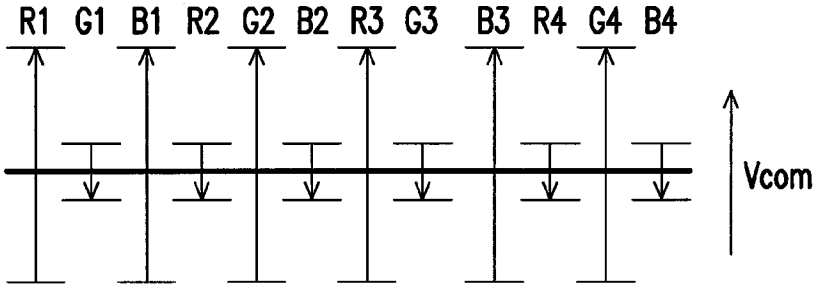
FIG. 2 (RELATED ART)
FIG. 2 illustrates a schematic waveform diagram of driving voltage outputted by each driving channel in FIG. 1 when being configured to drive the second pixel line.
Figure 3:
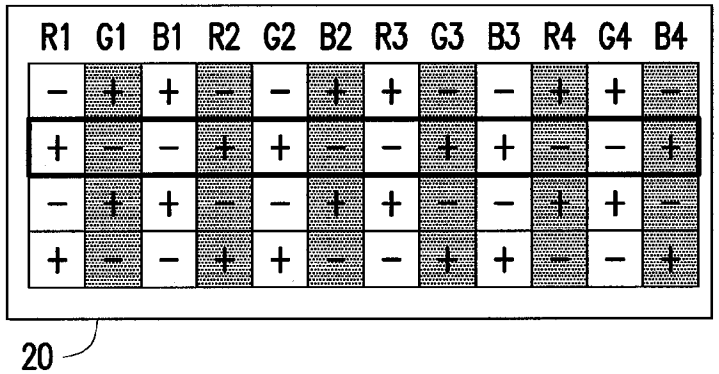
FIG. 3 (RELATED ART)
FIG. 3 illustrates a polarity distribution of pixels appeared in a dot inversion on a conventional display panel 20.
Figure 4:
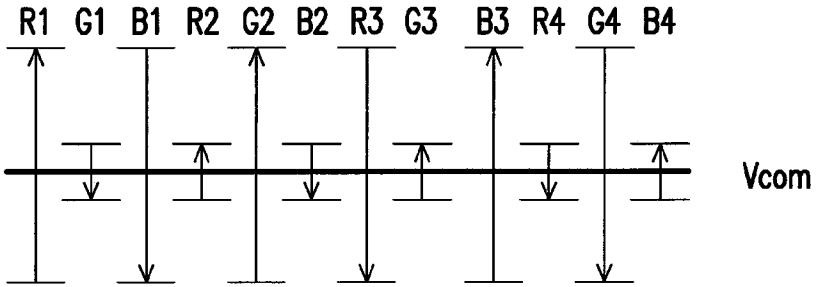
FIG. 4 (RELATED ART)
FIG. 4 illustrates a schematic waveform diagram of driving voltage outputted by each driving channel in FIG. 3 when being configured to drive the second pixel line.
Figure 7:
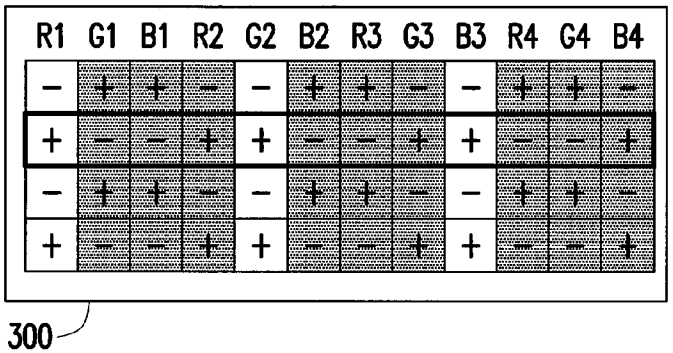
FIG. 7 illustrates a polarity distribution of pixels appeared in an alternative dot inversion on a display panel 300 according to a related example of the invention.
Figure 8:
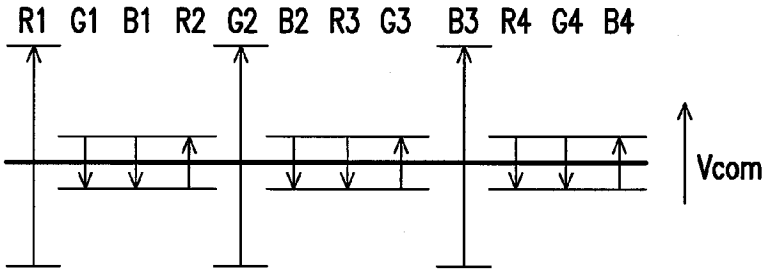
FIG. 8 illustrates a schematic waveform diagram of driving voltage outputted by each driving channel in FIG. 7 when being configured to drive the second pixel line.

Specifically, FIG. 7 illustrates a polarity distribution of pixels appeared in an alternative dot inversion on a display panel 300 according to a related example of the invention, and FIG. 8 illustrates a schematic waveform diagram of driving voltage outputted by each driving channel in FIG. 7 when being configured to drive the second pixel line. Referring to FIG. 7 and FIG. 8, a polarity distribution of the pixels on the display panel 300 of FIG. 7 is the same as the one illustrated FIG. 3, such that the two are both appeared in the distribution of horizontal-2-dot inversion, except that display patterns between the two are different. In FIG. 3, the display pattern of the display panel 20 are the brightest grayscale (with a pixel column display gray value of 225) driven by driving channels R1, B1, G2, R3, B3 and G4, and the darkest grayscale (with a pixel column display gray value of 0) driven by driving channels G1, R2, B2, G3, R4 and B4; and herein, the display pattern of the display panel 20 is defined as the second display pattern. In FIG. 7, the display pattern of the display panel 300 are the brightest grayscale (with a pixel column display gray value of 225) of pixel columns driven by driving channels R1, G2 and B3, and the darkest grayscale (with a pixel column display gray value of 0) driven by driving channels G1, B1, R2, B2, R3, G3, R4, G4 and B4; and herein, the display pattern of the display panel 300 is defined as a second display pattern. It can be known from the waveform of the driving voltage shown in FIG. 8 that, an aggregated overall effect of the driving voltage outputted by each driving channel may cause the common electrode voltage Vcom to shift upward, and therefore, in terms of the second display pattern, by using a horizontal-2-dot inversion to drive the display panel 300, the common electrode voltage Vcom would still be shifted upward, and the condition of having poor screen display is unable to be effectively improved.

Figure 9:
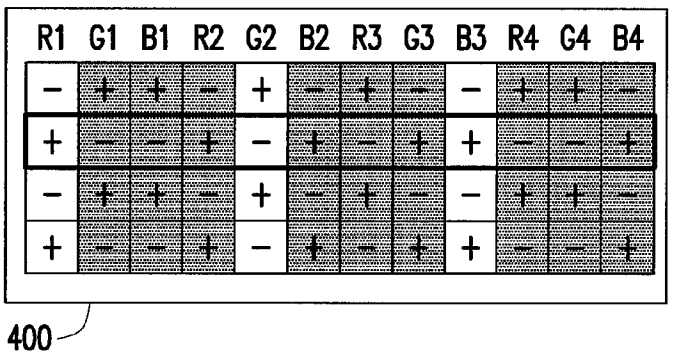
FIG. 9 illustrates a polarity distribution of pixels appeared in an adaptive dot inversion on a display panel 400 according to an embodiment of the invention.
Figure 10:
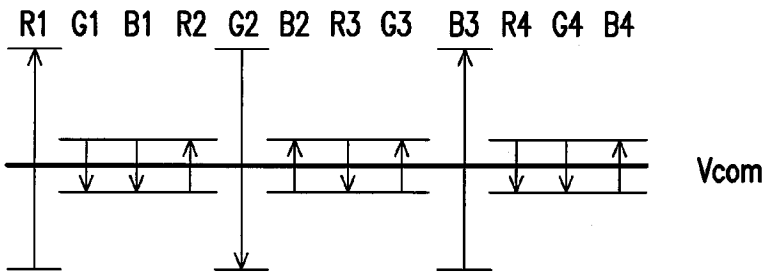
FIG. 10 illustrates a schematic waveform diagram of driving voltage outputted by each driving channel in FIG. 9 when being configured to drive a second pixel line.

FIG. 9 illustrates a polarity distribution of pixels appeared in an adaptive dot inversion on a display panel 400 according to an embodiment of the invention, and FIG. 10 illustrates a schematic waveform diagram of driving voltage outputted by each driving channel in FIG. 9 when being configured to drive the second pixel line. Referring to FIG. 9 and FIG. 10, in FIG. 9, the pattern displayed by the display panel 400 is the same as that of the display panel 300, and is also the second display pattern. In the present embodiment, the polarity distribution of the pixels on the display panel 400, for example, is dynamically determined by the data operation circuit 110 shown in FIG. 5 according to the second display pattern. Moreover, the pixel driving circuit 120 further drives the display panel 400 according to the determined polarity distribution information Sp2. Therefore, the polarity distribution of the pixels, as shown in FIG. 9, is based on the horizontal-2-dot inversion, except that the polarity distribution of the pixel columns driven by the driving channels G2 and B2 has undergone an adaptive dynamic adjustment according to the second display pattern. Hence, it can be known from the waveform of the driving voltage shown in FIG. 10 that, the coupling effect to the common electrode voltage Vcom caused by every pixel during charging and discharging would cancel each other out, so that the common electrode voltage Vcom would not be shifted, and thereby the condition of having poor screen display is improved.

In general, common driving methods of polarity inversions, in addition to the dot inversion and the horizontal-2-dot inversion, also include a driving method of an I-line inversion. The driving method of the display panel may also be used to dynamically adjust the polarity distribution of the panel pixels in the I-line inversion.

Figure 11:
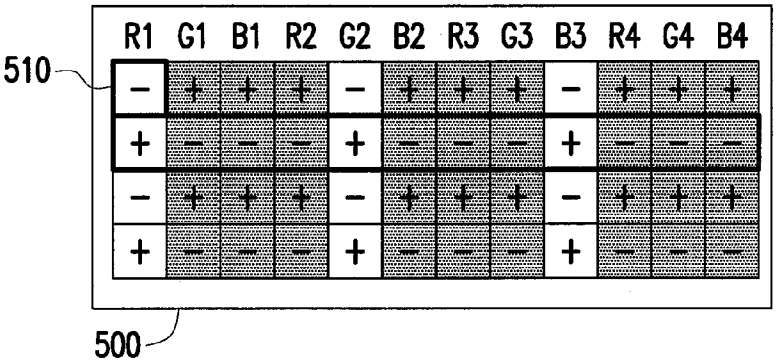
FIG. 11 illustrates a polarity distribution of pixels appeared in an adaptive single dot inversion on a display panel 500 according to another embodiment of the invention.
Figure 12:
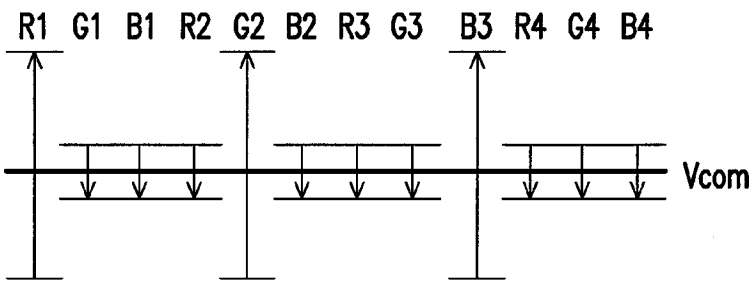
FIG. 12 illustrates a schematic waveform diagram of driving voltage outputted by each driving channel in FIG. 11 when being configured to drive the second pixel line.

FIG. 11 illustrates a polarity distribution of pixels appeared in adaptive single dot inversion on a display panel 500 according to another embodiment of the invention, and FIG. 12 illustrates a schematic waveform diagram of driving voltage outputted by each driving channel in FIG. 11 when being configured to drive the second pixel line. Referring to FIG. 11 and FIG. 12, also taken the display panel 500 displaying the second display pattern as an example, the data operation circuit 110 perfonns the polarity determination operation on the pixel data Sp1 to determine the polarity distribution information Sp2 of pixels 510 on the display panel 500. Next, the pixel driving circuit 120 further drives the display panel 500 according to the pixel data Sp1 and the polarity distribution information Sp2. Therefore, the polarity distribution of the pixels on the display panel 500, as shown in FIG. 11, is based on the 1-line inversion, except that the polarity distribution of the pixel columns driven by the driving channels R2, G3, and B4 has undergone an adaptive adjustment according to the second display pattern.

The offset effect on the common electrode voltage Vcom under different driving methods of polarity inversions according to the third display pattern of an arbitrary random picture, and the application of using the driving method of the display panel of the present disclosure to reduce the offset effect are described in the following.

Figure 13:
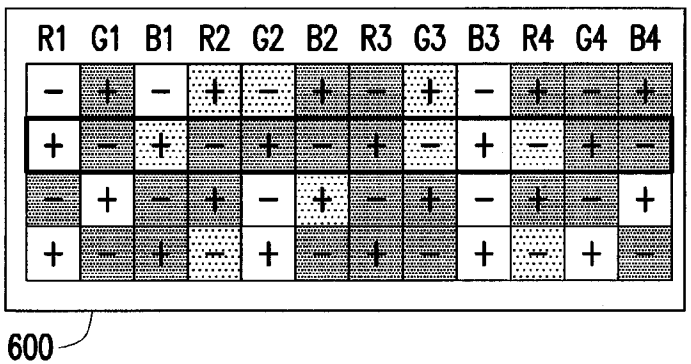
FIG. 13 and FIG. 15 respectively illustrate polarity distributions of pixels on display panels 600 and 700 according to two related examples of the invention.
Figure 14:
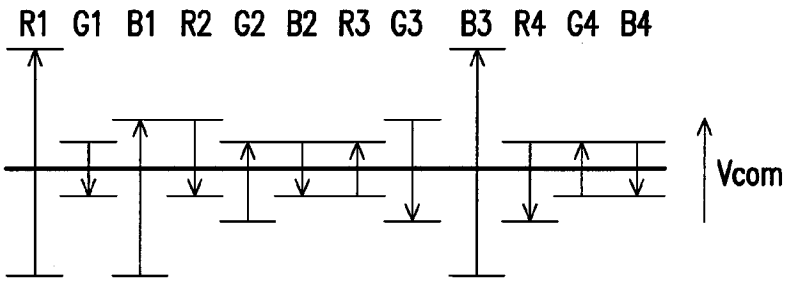
FIG. 14 and FIG. 16 respectively illustrate schematic waveform diagrams of driving voltage outputted by each driving channel in FIG. 13 and FIG. 15 when being configured to drive the second pixel line.
Figure 15:
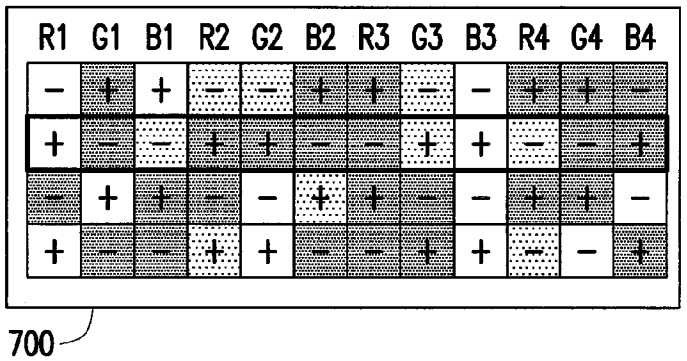
Figure 16:
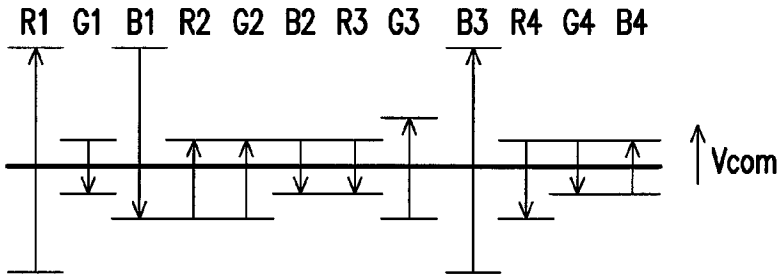

FIG. 13 and FIG. 15 respectively illustrate polarity distributions of pixels on display panels 600 and 700 according to two related examples of the invention, and FIG. 14 and FIG. 16 respectively illustrate schematic waveform diagrams of driving voltage outputted by each driving channel in FIG. 13 and FIG. 15 when being configured to drive the second pixel line. Referring to FIG. 13 through FIG. 16, the display panel 600 is driven by the dot inversion, and the display panel 700 is driven by the horizontal-2-dot inversion. In the two examples, when the display panels 600 and 700 are displaying the third display pattern, every pixel produces the coupling effect to the common electrode voltage Vcom during charging and discharging, and as a result, the common electrode voltage Vcom produces a considerable offset, as respectively shown FIG. 14 and FIG. 16, wherein a degree of shifting upward of the voltage common electrode Vcom of the display panel 600 is greater than that of the display panel 700.

Figure 17:
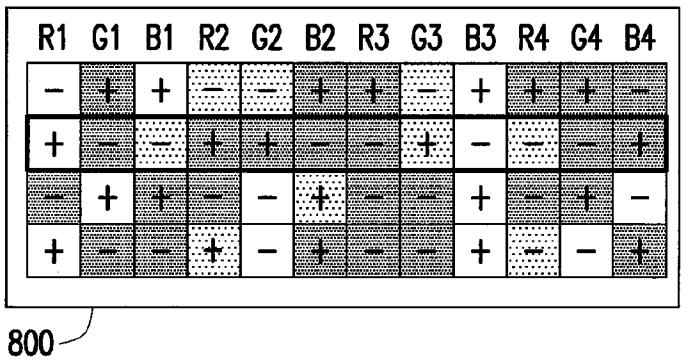
FIG. 17 illustrates a polarity distribution of pixels driven by an adaptive polarity inversion on a display panel 800 according to another embodiment of the invention.
Figure 18:
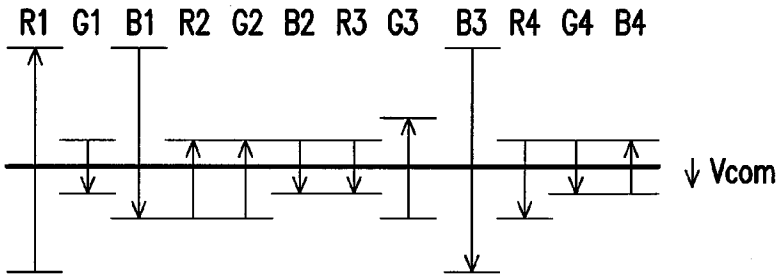
FIG. 18 illustrates a schematic waveform diagram of driving voltage outputted by each driving channel in FIG. 17 when being configured to drive a second pixel line.

FIG. 17 illustrates a polarity distribution of pixels driven by the adaptive polarity inversion on a display panel 800 according to another embodiment of the invention, and FIG. 18 illustrates a schematic waveform diagram of driving voltage outputted by each driving channel in FIG. 17 when being configured to drive the second pixel line. Referring to FIG. 17 and FIG. 18, in FIG. 17, a pattern displayed by the display panel 800 is the same as that of the display panels 600 and 700, and is also the third display pattern. In the present embodiment, the polarity distribution of the pixels on the display panel 800, for example, is dynamically determined by the data operation circuit 110 of FIG. 5 according to the random third display pattern. Moreover, the pixel driving circuit 120 then drives the display panel 800 according to the determined polarity distribution information Sp2. Therefore, the polarity distribution of the pixels is as shown in FIG. 17, and the polarity distribution of every pixel on the display panel 800 has undergone an adaptive dynamic adjustment according to the third display pattern. Hence, it can be known from the waveform of the driving voltage shown in FIG. 18 that, the coupling effect to the common electrode voltage Vcom caused by every pixel during charging and discharging would cancel each other out, and may reduce the offset of the common electrode voltage Vcom, thereby improving the condition of having poor screen display.

Referring to FIG. 5 and FIG. 6 again. In this exemplary embodiment, the data operation circuit 110, for example, sequentially performs the polarity determination operation on the pixel data of the entire pixels of each of the pixel lines to determine the polarity distribution information of the pixels 210 on the display panel 200. For instance, the data operation circuit 110 of the present embodiment firstly performs the polarity determination operation on the pixel data of the entire pixels of the first pixel line to determine the polarity distribution of the entire pixels of the first pixel line. Next, the data operation circuit 110 of the present embodiment performs the polarity determination operation on the pixel data of the entire pixels of the second pixel line to determine the polarity distribution of the entire line of the second pixel line. Afterward, the data operation circuit 110, according to the above rule, successively performs the polarity determination operation on the pixel data of the entire pixels of the next pixel line, and thereby determines the polarity distribution information of all the pixels on the display panel 200.

In the present disclosure, the data operation circuit 110 may also sequentially perform the polarity determination operation on the pixel data of at one least part pixels of each of the pixel lines to determine the polarity distribution information of the at least part pixels on the display panel, specified as follows.

Figure 19:
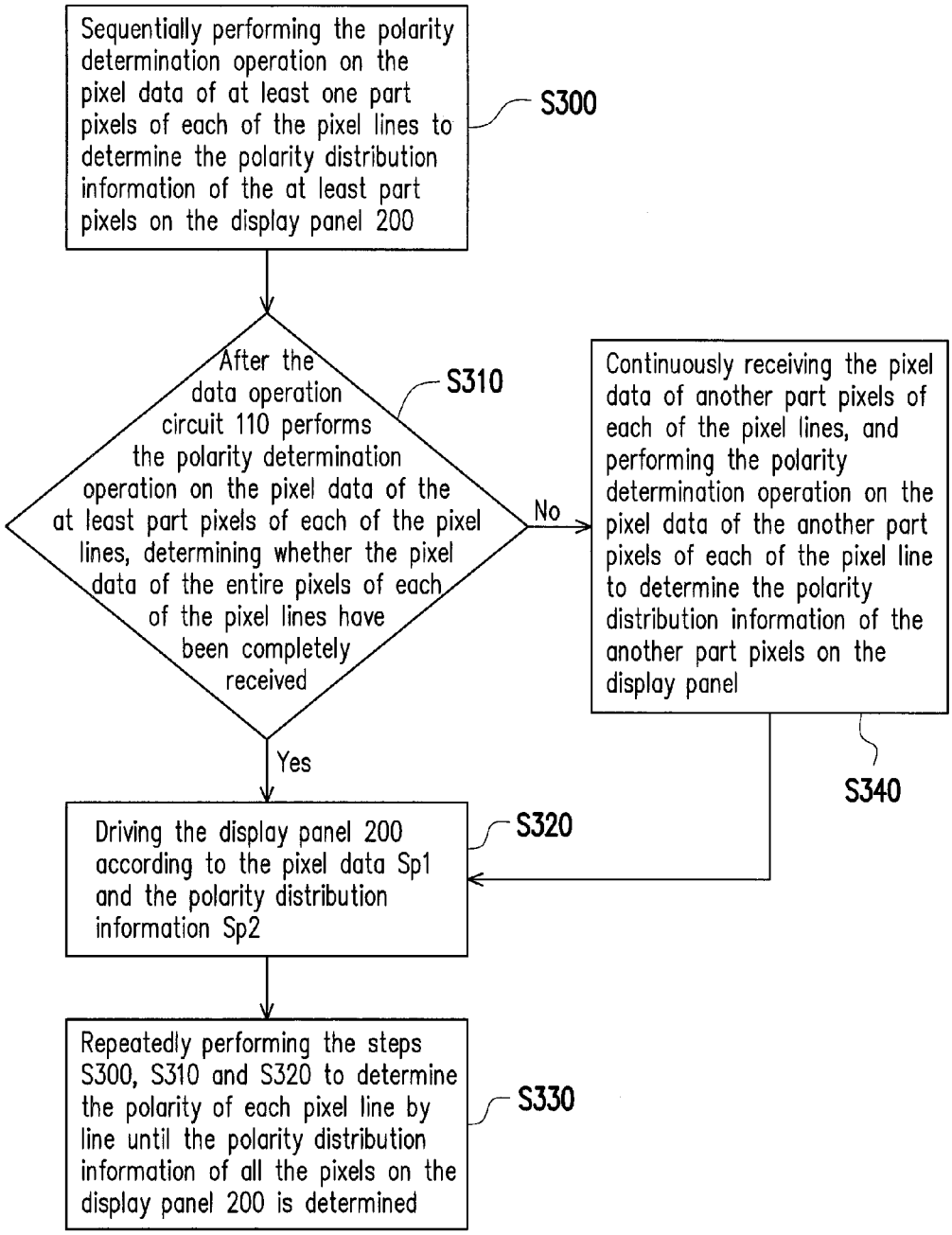
FIG. 19 illustrates a flow chart of a driving method of the display panel according to another embodiment of the invention.

FIG. 19 illustrates a flow chart of a driving method of the display panel according to another embodiment of the invention. Referring to FIG. 5 and FIG. 19, in step S300, the data operation circuit 110 sequentially performs the polarity determination operation on the pixel data of the at least one part pixels of each of the pixel lines to determine the polarity distribution information of the at least part pixels on the display panel 200. Taken the first pixel line as an example, the data operation circuit 110 firstly performs the polarity determination operation on the pixel data of the pixels driven by the driving channels R1, G1, B1, R2, G2 and B2 in the first pixel line, so as to determine the polarity of these pixels.

Next, in step S310, after the data operation circuit 110 performed the polarity determination operation on the pixel data of the at least one part pixels of each of the pixel lines, the pixel data of the entire pixels of each of the pixel lines are determined on whether they have been completely received. In other words, after performing the polarity determination operation on the pixel data of the pixels driven by the driving channels R1, G1, B1, R2, G2 and B2, the data operation circuit 110 determines the other pixels remaining in the first pixel line. Namely, the data operation circuit 110 determines whether the pixel data of the pixels driven by the driving channels R3, G3, B3, R4, G4 and B4 have been completely received.

Afterward, in step S320, if the pixel data of the entire pixels of each of the pixel lines have been completely received, and the polarity distribution information of the entire pixels of each of the pixel lines has been determined, then the pixel driving circuit 120 drives the display panel 200 according to the pixel data Sp1 and the polarity distribution information Sp2. In other words, if the pixel data of the pixels driven by the driving channels R3, G3, B3, R4, G4 and B4 have been completely received, and the polarity distribution information of these pixels has been determined, then the pixel driving circuit 120 drives the first pixel line of the display panel 200 according to the pixel data Sp1 and the polarity distribution information Sp2.

Subsequently, in step S330, the data operation circuit 110 and the pixel driving circuit 120 repetitively perform the steps S300, S310 and S320 to determine the polarity of each pixel line by line, until the polarity distribution information of all the pixels on the display panel 200 is determined. Afterward, the pixel driving circuit 120 drives the display panel 200 according to the pixel data Sp1 and the polarity distribution information Sp2.

On the other hand, in step S340, if the pixel data of the entire pixels of each of the pixel lines have not yet been completely received, then the data operation circuit 110 continues to receive the pixel data of another part pixels of each of the pixel lines and performs the polarity determination operation on the pixel data of the another part pixels of each of the pixel lines to determine the polarity distribution information of the another part pixels on the display panel. For instance, if in the first pixel line, the pixel data of the pixels driven by the driving channels R3, G3, B3, R4, G4 and B4 have not yet been completely received, then the data operation circuit 110 continues to receive the pixel data of the pixels driven by the driving channels R3, G3, B3 , R4, G4 and B4 and performs the polarity determination operation on the pixel data of the pixel driven by the driving channels R3, G3, B3, R4, G4 and B4 to determine the polarity of the pixels in the first pixel line, and thereby determines the polarity distribution information of the entire pixels of the first pixel line.

The driving methods disclosed in FIG. 6 and FIG. 19 are demonstrated by adaptively and dynamically adjusting the polarity of all the pixels on the display panel 200, but the invention is not limited thereto. In another embodiment, the driving method of the disclosure may also just adaptively and dynamically adjust the polarity of a part of the pixels on the display panel 200, while the other part of the pixels is driven by the preset polarity distribution information, specified as follows.

Figure 20:
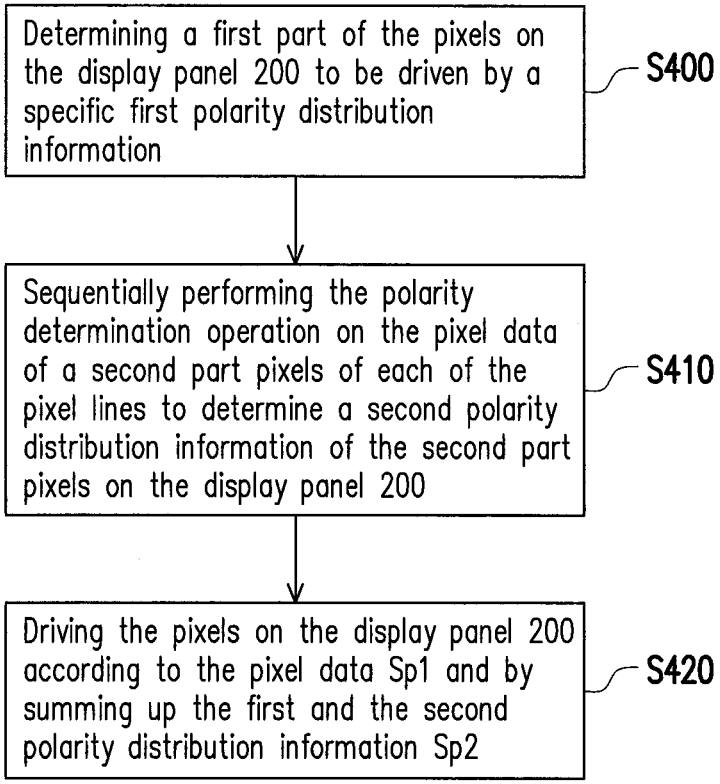
FIG. 20 illustrates a flow chart of a driving method of the display panel according to yet another embodiment of the invention.

FIG. 20 illustrates a flow chart of a driving method of the display panel according to yet another embodiment of the invention. Referring to FIG. 5 and FIG. 20, in step S400, the data operation circuit 110 firstly determines that a first part of the pixels on the display panel 200 is to be driven by the specific first polarity distribution information. This first polarity distribution information, for example, is a preset polarity driving method including one of the frame inversion, the column inversion, the line inversion and the dot inversion. The first polarity distribution information does not perform the adaptive and dynamic adjustment according to the screen display pattern, and it is, for example, determined by a circuit outside of the source driver apparatus 100. The first part of the pixels herein, for example, includes the pixels driven by the driving channels R3, G3, B3, R4, G4 and B4.

Next, in step S410, the data operation circuit 110 sequentially performs the polarity determination operation on the pixel data of the second part pixels of each of the pixel lines to determine the second polarity distribution information of the second part of the pixels on the display panel 200. The second part pixels herein, for example, are the pixels driven by the driving channels R1, G1, B1, R2, G2 and B2 . Therefore, in this step, the data operation circuit 110 performs the adaptive and dynamic adjustment to the second part pixels according to the screen display pattern. It is to be noted that, in this step, a method for determining the second polarity distribution information, for instance, may be referred to the driving methods illustrated in FIG. 6 or FIG. 19, and thus is not to be repeated herein.

Afterward, in step S420, the pixel driving circuit 120 further drives the pixels on the display panel 200 according to the pixel data Sp1 and by summing up the first and the second polarity distribution information Sp2.

In summary, in the embodiments of the invention, the source driver apparatus uses the aforementioned driving method to adaptively and dynamically adjust the polarity distribution of the pixels on the display panel. With this driving method, the coupling effect to the common electrode voltage caused by every pixel during charging and discharging would cancel each other, and may reduce the offset of the common electrode voltage, thereby improving the condition of having poor screen display.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A source driver apparatus configured to drive a display panel, the source driver apparatus comprising:

a data operation circuit configured to receive pixel data and perform a polarity determination operation on the pixel data to determine a polarity distribution information of a plurality of pixels on the display panel; and a pixel driving circuit coupled to the data operation circuit and configured to adaptively and dynamically adjust a polarity distribution of the pixels on the display panel, to drive the display panel according to the pixel data and the polarity distribution information, wherein the display panel comprises a plurality of pixel lines, the data operation circuit sequentially performs the polarity determination operation on the pixel data of at least one part pixels of each of the pixel lines to determine the polarity distribution information of the at least one part pixels of the display panel, wherein after the data operation circuit sequentially performs the polarity determination operation on the pixel data of the at least one part pixels of each of the pixel lines, the data operation circuit determines whether the pixel data of the entire pixels of each of pixel lines have been completely received.

2. The source driver apparatus as recited in claim 1, wherein if the pixel data of the entire pixels of each of the pixel lines have been completely received, and the polarity distribution information of the entire pixels of each of the pixel lines has been determined, then the pixel driving circuit drives the display panel according to the pixel data and the polarity distribution information.

3. The source driver apparatus as recited in claim 1, wherein if the pixel data of the entire pixels of each of the pixel lines have not yet been completely received, then the data operation circuit continuously receives the pixel data of another part pixels of each of the pixel lines and performs the polarity determination operation on the pixel data of the another part pixels of each of the pixel lines to determine the polarity distribution information of the another part pixels on the display panel.

4. The source driver apparatus as recited in claim 1, wherein the pixel driving circuit is further configured to drive another part pixels of each of the pixel lines on the display panel according to another polarity distribution information.

5. A driving method of a display panel, comprising:

receiving pixel data;

performing a polarity determination operation on the pixel data to determine a polarity distribution information of a plurality of pixels on the display panel; and adaptively and dynamically adjusting a polarity distribution of the pixels on the display panel to drive the display panel according to the pixel data and the polarity distribution information, wherein the step of performing the polarity determination operation on the pixel data comprises:

sequentially performing the polarity determination operation on the pixel data of at least one part pixels of each of the pixel lines to determine the polarity distribution information of the at least one part of the pixels on the display panel, after performing the polarity determination operation on the pixel data of the at least one part pixels of each of the pixel lines, determining whether the pixel data of the entire pixels of each of the pixel lines have been completely received.

6. The driving method of the display panel as recited in claim 5 , wherein if the pixel data of the entire pixels of each of pixel lines have been completely received, and the polarity distribution information of the entire pixels of each of the pixel lines has been determined, then driving the display panel according to the pixel data and the polarity distribution information.

7. The driving method of the display panel as recited in claim 5, wherein if the pixel data of the entire pixels of each of pixel lines have not yet been completely received, then the step of performing the polarity determination operation on the pixel data further comprises:

continuously receiving the pixel data of another part pixels of each of the pixel lines and performing the polarity determination operation on the pixel data of the another part pixels of each of the pixel lines to determine the polarity distribution information of the another part pixels on the display panel.

8. The driving method of the display panel as recited in claim 5, further comprising:

driving another part pixels of each of the pixel lines on the display panel according to another polarity distribution information.

* * * * *